United States Patent [19]

Connell

[11] Patent Number: 4,944,413

[45] Date of Patent: Jul. 31, 1990

[54] BOOK SUPPORT APPARATUS

[76] Inventor: Wallace J. Connell, 604 W. 12th St., Juneau, Ak. 99801

[21] Appl. No.: 211,296

[22] Filed: Jun. 24, 1988

[51] Int. Cl.[5] ..... A47F 5/00

[52] U.S. Cl. ..... 211/42; 211/11

[58] Field of Search ..... 211/132, 42, 43, 40, 211/73, 70.1, 11

[56] References Cited

U.S. PATENT DOCUMENTS

| | | | |
|---|---|---|---|
| 1,619,420 | 3/1927 | Hoth . | |
| 1,750,575 | 3/1930 | Cubberley . | |
| 2,537,565 | 1/1951 | Wolters | 211/11 |
| 3,604,564 | 9/1971 | Weyll | 211/42 X |
| 3,632,010 | 1/1972 | Marty | 220/6 |
| 3,759,395 | 9/1973 | Juhlin | 211/40 |
| 3,870,156 | 3/1975 | O'Neill | 211/74 |
| 4,099,624 | 7/1978 | McKearin | 211/42 |
| 4,438,852 | 3/1984 | Evans | 211/11 |

FOREIGN PATENT DOCUMENTS

| | | | |
|---|---|---|---|
| 180813 | 6/1922 | United Kingdom | 211/73 |

*Primary Examiner*—Robert W. Gibson, Jr.
*Attorney, Agent, or Firm*—Donald A. Kettlestrings

[57] ABSTRACT

Book support apparatus includes a thin planar base and a plurality of thin planar supports projecting vertically from the base whereby books, cards, notebooks or the like can be supported and stored within the apparatus. The base and vertically projecting supports are flat to permit quick and easy insertion into and removal from the apparatus of books or the like, and the base and supports are comprised of very thin material to enable the apparatus to unobtrusively visually blend in with the stored books.

6 Claims, 1 Drawing Sheet

BOOK SUPPORT APPARATUS

This invention relates to support apparatus and more particularly to apparatus for supporting books and the like.

Typical right-angle shaped book ends have been used for centuries, but such book ends are unstable and inconvenient to use. If a book end is dislodged, the books previously supported by the book end are no longer properly supported. As a result, the books fall or are otherwise displaced from their proper positions. It is also inconvenient to insert or to remove books from a stack which is supported by conventional book ends.

It is, therefore, an object of the present invention to provide support apparatus for books, cards, notebooks or the like which are stiff enough to be stored on edge.

Another object is to provide a book support apparatus which is self-contained and which is inherently stable.

A further object of the invention is the provision of such a support apparatus which permits books to be quickly and easily inserted or removed from a stack of supported volumes.

Still another object is to provide such a book support apparatus which is unobtrusive in appearance and which visually blends in with the stored books to give the appearance of books standing on their own without additional support.

Yet another object of the present invention is the provision of such an apparatus which can be used together with similar apparatus to support and control books over an extended distance.

A still further object is to provide such an apparatus which is relatively easy and inexpensive to manufacture.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides book support apparatus, comprising: a substantially planar base defining exposed front and rear edges and further defining left and right-end edges; a first substantially planar support defining exposed front, rear and top edges, the first support permanently attached to and projecting upwardly from the left-end edge of the planar base at an angle of substantially ninety degrees with the base; a second substantially planar support defining exposed front, rear and top edges, the second support permanently attached to and projecting upwardly from the right-end edge of the base and at an angle of substantially ninety degrees with the base; and at least a third substantially planar support defining exposed front, rear and top edges, the third support permanently attached to and projecting upwardly from the base at an angle of substantially ninety degrees therewith.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
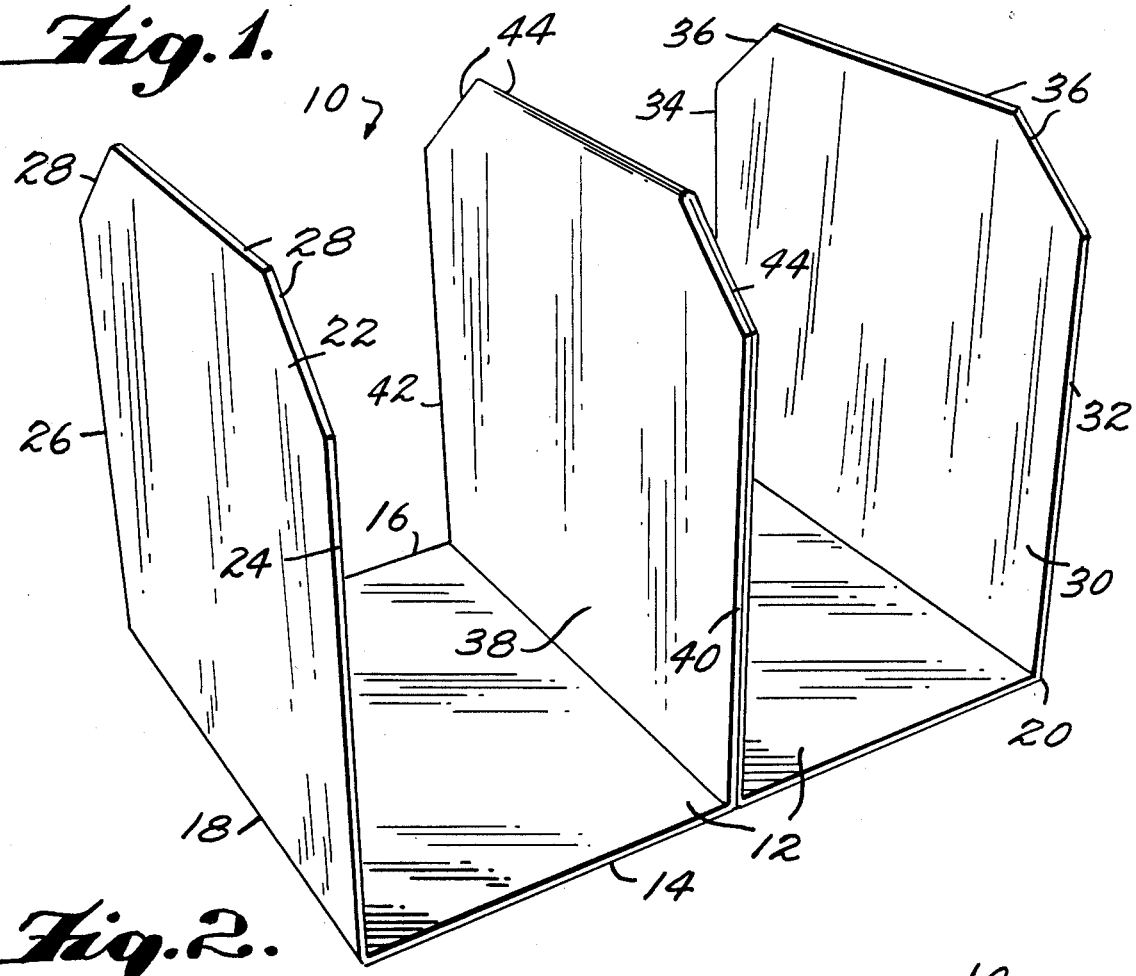
FIG. 1 is perspective view of the book support apparatus.
Figure 2:
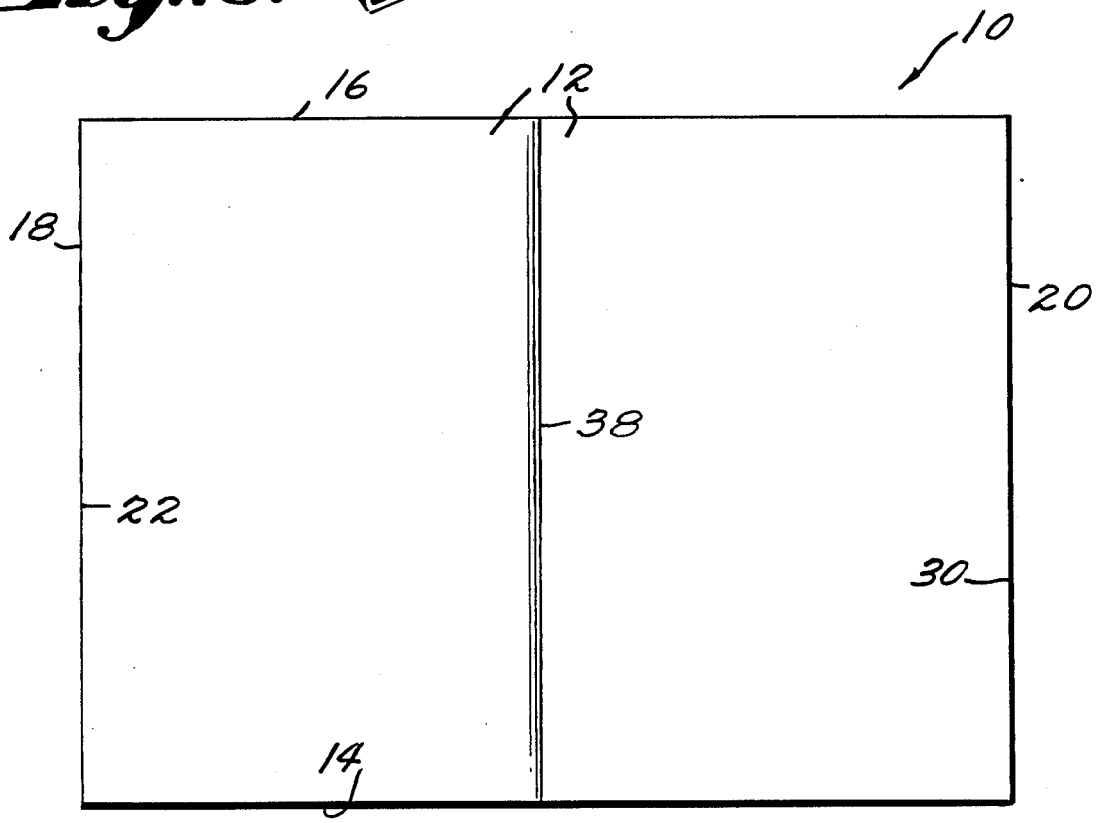
FIG. 2 is a top plan view of the book support apparatus.

With reference now to the drawings, wherein like reference characters designate like or corresponding parts throughout the several views, there is shown book support apparatus 10 in accordance with this invention. Apparatus 10 includes a thin substantially planar base 12 of a first predetermined thickness defining thin exposed front and rear edges 14, 16, respectively. Base 12 further defines thin left and right-end edges 18, 20, respectively.

Each of thin edges 14, 16, 18 and 20 is of the same thickness as the remaining portions of base 12. This is an important structural feature of apparatus 10 to facilitate quick and easy insertion and removal of books or the like with respect to apparatus 10. This feature of apparatus 10 also enhances the visual impression that books which are actually held within apparatus 10 are independently supported.

A first thin substantially planar support 22 of second predetermined thickness defines thin exposed front, rear and top edges 24, 26 and 28, respectively. Each of edges 24, 26 and 28 is of the same thickness as the remaining portions of support 22 to enhance easy insertion of books into and withdrawal of books from apparatus 10. Support 22 is permanently attached to and projects upwardly from left-end edge 18 at an angle of substantially ninety degrees with base 12.

A second thin substantially planar support 30 of third predetermined thickness defines thin exposed front, rear and top edges 32, 34 and 36. Each of edges 32, 34 and 36 is of the same thickness as the remaining portions of support 30, and support 30 is permanently attached to and projects upwardly from right-end edge 20 at an angle of substantially ninety degrees with base 12.

At least a third thin substantially planar support 38 of fourth predetermined thickness defines thin exposed front, rear and top edges 40, 42 and 44. Each of edges 40, 42 and 44 is of the same thickness as the remaining portions of support 38, and support 38 is permanently attached to and projects upwardly from base 12 at an angle of substantially ninety degrees with the base.

Preferably, the thicknesses of base 12 and of supports 22, 30 and 38 are the same or substantially the same, and edges 14, 16, 18 and 20 of base 12 are preferably straight. Base 12 is preferably substantially rectangular in shape to provide optimum stability and storage capacity. Each of supports 22, 30 and 38 are also substantially rectangular in overall shape with trapezoidally shaped top portions to provide optimum support. It should be understood, however, that different shapes or configurations for base 12 and for supports 22, 30 and 38 can be provided.

Typical dimensions for apparatus 10 provide that front and rear edges 14, 16 be nine inches in length. Left-end and right-end edges 18, 20 are six inches in length and the overall height of each support 22, 30 and 38 is six and one half inches. Apparatus 10, as illustrated, is divided evenly into two compartments, each four and one half inches wide. Apparatus 10 may be comprised of any durable and rigid material, and one example is the use of sixteen gauge aluminum approximately 0.063 inch thick for each portion of the apparatus. Alternatively, apparatus 10 can be made of eighteen gauge aluminum of 0.040 inch thickness, twenty gauge steel, plastic or any other material which is rigid and strong enough to control and hold books without being too bulky and heavy.

It should be understood that the dimensions of apparatus 10 can be varied, as desired. More than one interior support 38 also can be provided so that three or more book storage compartments are available.

Apparatus 10 can be used alone or in any combination of numbers to hold and control a number of books, cards, notebooks or similar items which are stiff enough to be stored on edge. Apparatus 10 can be used on desk tops, tables or shelves. Several units of apparatus 10 can be used in combination to control a large number of books on a long open shelf. Because of the very thin dimensions of base 12 and of supports 22, 30 and 38, apparatus 10 almost disappears from view as it blends in with the stored books. The absence of any raised surfaces along the edges of the base and of the supports helps to reduce the visability of the apparatus as it holds the books and enables the apparatus to visually blend in with the stored books to give the appearance of books standing on end in an orderly fashion without any external support. The absence of any raised surfaces adjacent to the edges of base 12 and adjacent to the edges of the supports also makes it easy to quickly and simply insert books into or remove books from apparatus 10 and also enables books to be inserted into or removed from the apparatus as easily from the rear as from the front thereof.

The invention in its broader aspects is not limited to the specific details shown and described, and departures may be made from such details without departing from principles of the invention and without sacrificing its chief advantages.

What is claimed is:

1. Book support apparatus, comprising:

a substantially planar base of first predetermined thickness defining exposed front and rear edges of said first thickness and further defining directly opposed left and right-end edges of said first thickness, each of said exposed front and rear edges defining visually discernible upper and lower margins;

a first substantially planar support of second predetermined thickness defining exposed front, rear and top edges of said second thickness, said first support permanently attached to and projecting upwardly from said left-end edge at an angle of substantially ninety degrees with said base;

a second substantially planar support of third predetermined thickness defining exposed front, rear and top edges of said third thickness, said second support permanently attached to and projecting upwardly from said right-end edge at an angle of substantially ninety degrees with said base; and at least a third substantially planar support of fourth predetermined thickness defining exposed front, rear and top edges of said fourth thickness, said third support permanently attached to and projecting upwardly from said base between said left and right-end edges and at an angle of substantially ninety degrees with said base.

2. Apparatus as in claim 1 wherein said first, second, third and fourth thicknesses are substantially the same.

3. Apparatus as in claim 2 wherein said front, rear, left-end and right-end edges of said base are each straight.

4. Apparatus as in claim 3 wherein said base is substantially rectangular.

5. Apparatus as in claim 2 wherein said first, second and third planar supports are of substantially equal surface area with respect to each other.

6. Apparatus as in claim 5 wherein said first, second and third planar supports are of substantially equal height with respect to each other above said base.

* * * * *